US006517685B2

(12) United States Patent
Huovila et al.

(10) Patent No.: US 6,517,685 B2
(45) Date of Patent: Feb. 11, 2003

(54) PROCESS ARRANGEMENT FOR SHORT CIRCULATION

(75) Inventors: Jyrki Huovila, Muurame (FI); Michael Odell, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/897,528

(22) Filed: Jun. 29, 2001

(65) Prior Publication Data

US 2002/0060026 A1 May 23, 2002

Related U.S. Application Data

(63) Continuation of application No. PCT/FI99/01078, filed on Dec. 23, 1999.

(30) Foreign Application Priority Data

Dec. 30, 1998 (FI) ..... 982822

(51) Int. Cl.[7] ..... D21F 11/00

(52) U.S. Cl. ..... 162/258; 162/264; 162/336

(58) Field of Search ..... 162/189, 190, 162/216, 253, 258, 259, 264, 335, 336, 337, 343, 344, 345, 380

(56) References Cited

U.S. PATENT DOCUMENTS

| | | | | | |
|---|---|---|---|---|---|
| 4,081,319 | A | * | 3/1978 | Conway | 162/168.3 |
| 4,909,904 | A | * | 3/1990 | Kinzler | 162/336 |
| 5,196,091 | A | * | 3/1993 | Hergert | 162/258 |
| 5,316,383 | A | * | 5/1994 | Begemann et al. | 162/336 |
| 5,545,293 | A | * | 8/1996 | Huovila et al. | 162/212 |
| 5,549,793 | A | * | 8/1996 | Hellstrom et al. | 162/258 |
| 5,560,807 | A | | 10/1996 | Hauser | 162/183 |
| 5,866,905 | A | * | 2/1999 | Graf et al. | 162/336 |
| 5,958,189 | A | | 9/1999 | Begemann et al. | 162/264 |
| 6,113,741 | A | * | 9/2000 | Kettunen et al. | 162/158 |

FOREIGN PATENT DOCUMENTS

| | | | |
|---|---|---|---|
| DE | 195 09 522 A1 | 9/1996 | D21F/1/66 |
| DE | 197 36 047 A1 | 2/1999 | D21G/9/00 |
| EP | 0 898 014 A2 | 2/1999 | D21G/9/00 |
| FI | 88415 | 1/1993 | |

OTHER PUBLICATIONS

PCT International Preliminary Examination Report for PCT/FI99/01078.

PCT International Preliminary Examination Report for PCT/FI99/01078, May 14, 2001.

International Search Report issued in International Patent Application No. PCT/FI99/01078, May 4, 2000.

National Board of Patents and Registration Official Action dated Nov. 08, 1999 in Patent Application No. 982822.

* cited by examiner

*Primary Examiner*—Steven P. Griffin
*Assistant Examiner*—Eric Hug
(74) *Attorney, Agent, or Firm*—Lathrop & Clark LLP

(57) ABSTRACT

The invention concerns the short circulation of a paper or board machine and in particular a simplified process arrangement for the short circulation, which arrangement comprises a metering system (20) for the stock (M) or stocks, pumps (110, 130, 170), a headbox (150), and a wire part (160) as well as a pipe system interconnecting the devices, with means of regulation, and in which arrangement a high-consistency stock (3) is fed into the headbox (150), and the white water (4) recovered from the wire part (160) is fed by means of a diluting pump (170) into the headbox (150) so that diluting of the stock suspension is carried out in the headbox.

5 Claims, 2 Drawing Sheets

PROCESS ARRANGEMENT FOR SHORT CIRCULATION

CROSS REFERENCES TO RELATED APPLICATIONS

This application is a continuation of PCT Application No. PCT/FI99/01078, filed Dec. 23, 1999, and claims priority on Finnish Application No. 982822, filed Dec. 30, 1998, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention concerns the short circulation of a paper or board machine and in particular a simplified process arrangement for the short circulation.

In paper and board machines, the stock is fed out of a storage tank into a metering tank and from said tank further into a mixing tank, in which the stock components are mixed with each other. The mixed stock is passed into a machine tank, from which there is an overflow back into the mixing tank. The stock, whose consistency is about 3%, is fed from the machine tank into the wire pit of the short circulation, in which wire pit the high-consistency stock is diluted to a headbox consistency of about 1%. The fibres and fillers that are used as the raw-material for the paper or board are introduced on the wire through the headbox as carried by water, and the filtrate which has passed through the wire, which contains an abundance of fibrous matter and fillers, is returned as a dilution for the high-consistency stock arriving from the machine tank through the headbox back onto the wire. This flow loop is called the short circulation of the paper or board machine. Contaminations that have entered in the short circulation along with the high-consistency stock or otherwise are removed before the headbox by means of cleaning devices employed in the short circulation, which devices are vortex cleaners, screens and machine screens.

Ever stricter requirements concerning the protection of environment, in particular in respect of emissions and in respect of consumption of raw-materials and commodities and, on the other hand, an attempt to achieve better production efficiency and to minimize disturbance in the production have resulted in ever more closed systems and in a more closed short circulation and in maximally efficient recirculation of raw-materials and, on the other hand, in an ever higher wire retention level, in which case it is necessary to use a larger quantity of retention agents. The short circulations that are used currently in paper and board machines have rather complicated constructions, and the various operations in the process require apparatuses of their own, in which case a physically large process space is required and, on the other hand, the volumes in the process itself are also larger. Owing to the large process volume, the times taken by changes of grade are relatively long. The numerous expensive apparatuses require an abundance of space, and the maintenance, servicing and upkeep of separate apparatuses cause expenses. A conventional short circulation requires a number of pumps, screens and deaerators which have been dimensioned for the whole flow volume of the headbox. In the case of a dilution headbox, a double circulation is also required for the dilution water. In such a case, the first dilution takes place in the wire pit, and the second dilution in the headbox. In the future, when the running speeds of paper and board machines become higher than 2000 meters per minute, the pumping volumes become so large that the present-day systems are no longer adequate.

In the FI Patent 88,415, a process arrangement is described for production of the stock for the headbox of a paper machine in the short circulation. In the arrangement that is suggested, fresh stock is not mixed into the circulation water passing into the deaeration tank. In the arrangement, a combination wire pit is used, which has been divided into two separate compartments to constitute two jointly operative tanks. The first tank has been arranged as a feed tank for deaeration, and the second tank as a dilution tank for the headbox stock, into which tank fresh stock is fed. By means of this process arrangement, attempts have been made mainly to eliminate the essential problems caused by variations of consistency and pressure in the headbox.

SUMMARY OF THE INVENTION

The process arrangement in accordance with the present invention for the short circulation in a paper or board machine has a metering system for the stock or stocks, pumps, a headbox, and a wire part as well as a pipe system interconnecting the devices, with means of regulation, and in which arrangement a high-consistency stock is fed into the headbox, and the white water recovered from the wire part is fed by means of a diluting pump into the headbox so that diluting of the stock suspension is carried out in the headbox.

The object of the present invention is to provide a process arrangement for the short circulation in a paper or board machine, by means of which arrangement it is possible to solve and substantially to reduce the problems involved in the prior art.

It is a further object of the present invention to provide a simplified process arrangement for the short circulation, by means of which arrangement it is possible to reduce the process volumes and to integrate a number of operations with each other and to obtain economies and a process that loads the environment to a lower extent.

In the following, some preferred embodiments of the invention will be illustrated with reference to the figures in the accompanying drawings, the invention being, however, not supposed to be confined to the details of said illustrations.

DESCRIPTION OF THE PREFERRED EMBODIMENTS

Figure 1:
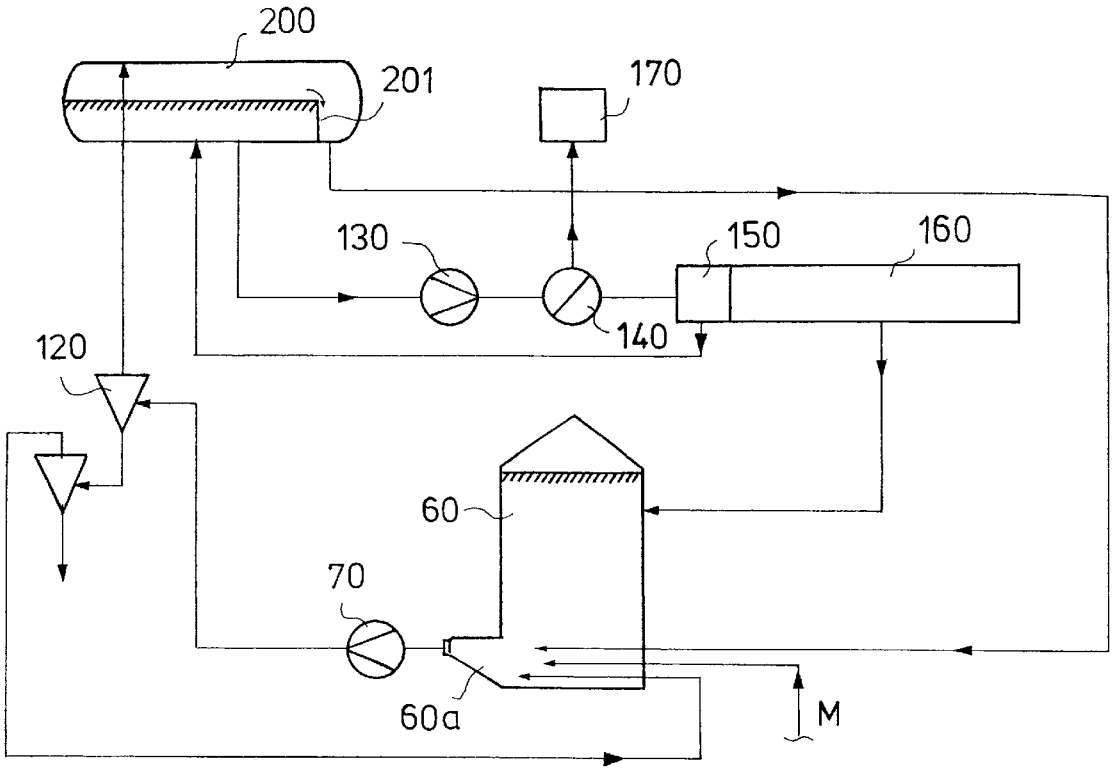
FIG. 1 is a schematic illustration of a conventional prior-art process arrangement for the short circulation.

In FIG. 1, the headbox 150 feeds a stock suspension jet to the wire part 160. The water collecting means of the wire part 160 pass the water drained through wire into the wire pit 60. Into the mixing area 60*a* of the wire pit 60, a flow of fresh stock M is fed, whose consistency is, as a rule, of an order of 3%. In the wire pit 60 the fresh stock is diluted to the headbox consistency, which is of an order of 1%.

Through the pump 70, the stock flow diluted to the headbox consistency is passed through vortex cleaners 120 into the deaeration tank 200, in which the level of the stock surface is determined by the overflow 201 of the deaeration tank 200, over which overflow a stock flow flows from which the air has been removed, which stock flow is passed further into the wire pit 60. Further, the return flow from the vortex cleaners 120 is passed to the wire pit 60. From the bottom part of the deaeration tank 200 the stock flow is passed to the stock pump 130, which feeds the intake stock flow through the machine screen 140 into the inlet header of the headbox 150, whose bypass flow is returned to the bottom part of the deaeration tank 200. The reject of the machine screen 140 is passed to the reject processing 170.

Figure 2:
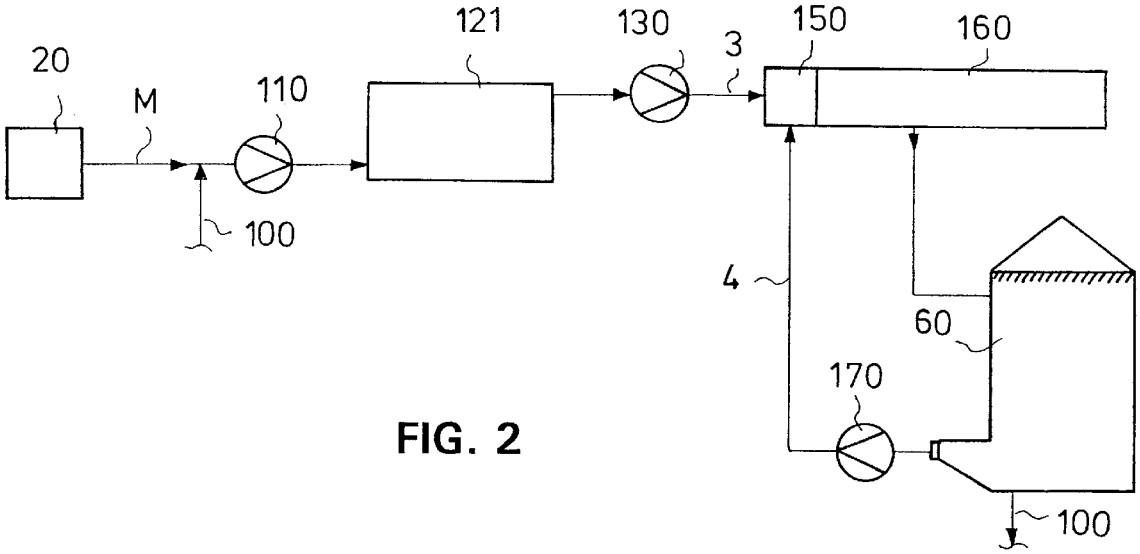
FIG. 2 is a schematic illustration of a process arrangement in accordance with the present invention for the short circulation of a paper machine.

In FIG. 2, the stock M, which may optionally often comprise different stocks, is fed from a metering tank 20 or metering system and further, by means of the pump 110 of the main line of the process, to cleaning stages 121, which comprise optionally screens, machine screens and vortex cleaners. The second pump 130 in the main line feeds the high-consistency stock 3 further into the headbox 150 and from it to the wire part 160, either conventionally or as a profiled feed. The white water recovered from the wire part 160 into the wire pit 60 is fed optionally through a deaeration equipment (not shown here) if the wire part mixes air to among the stock, by means of a dilution water pump 170 to the headbox 150 conventionally or by means of an inlet header and so that the stock suspension is diluted, or diluted by means of profiling dilution fraction by fraction, to the headbox consistency of 0.4 to 1.2%. From the recovered white water, it is also possible, optionally, to separate a component flow 100 and to pass the component flow 100 to the main line of the process before the pump 110 if the cleaning stages 121 require use of additional white water.

Figure 3:
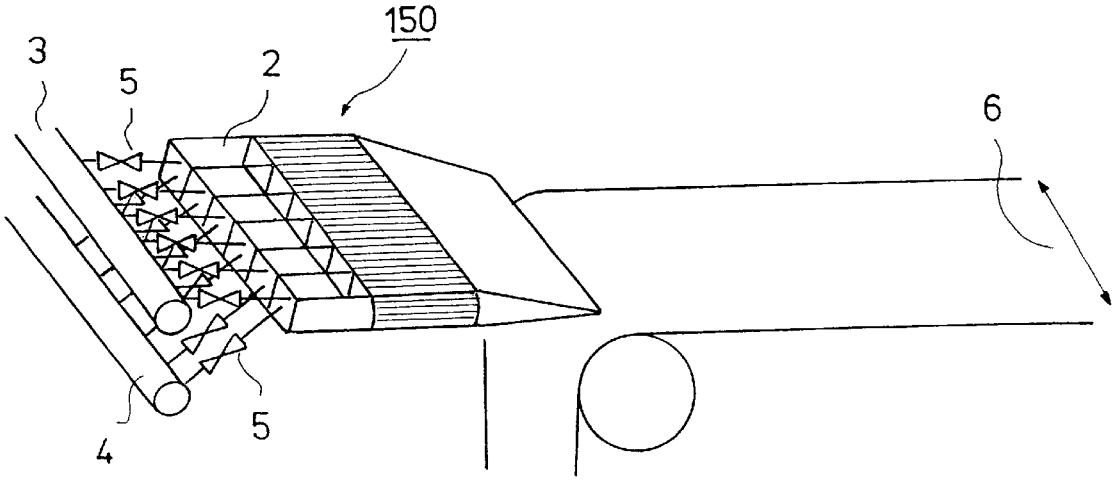
FIG. 3 is a schematic illustration of a feed fraction by fraction in accordance with the present invention.

FIG. 3 illustrates a feed fraction by fraction, which means that the headbox 150 has been divided into compartments 2 in the cross direction of the machine, into each of which compartments 2 high-consistency stock 3 and white water, i.e. dilution water 4, are fed separately, and the feed quantities of said stock and water can be regulated separately by means of valves 5. The consistency of the discharge jet can be regulated across the whole width 6 of the headbox 150.

In the simplified process arrangement in accordance with the present invention for the short circulation in a paper or board machine, the high-consistency stock is diluted by means of the water used for consistency profiling, in which case simultaneous dilution and profiling are concerned. For the dilution, white water recovered from the paper or board machine is used. Depending on the amount of air bound in the white water, any detrimental air is removed from the water before the white water is mixed with the high-consistency stock in the headbox. If the content of air in the white water is below a certain predetermined limit, air does not have to be removed from the water. The feed is carried out fraction by fraction, in which case either dilution fraction or high-consistency stock fraction or both are fed.

It is the objective of the profiling dilution achieved in this way that the consistency of the slice jet of the headbox can be regulated across the entire width of the headbox, i.e. in the cross direction of the machine. In each compartment, the consistency is regulated based on measurement of the basis weight profile, in which connection the measurement is carried out in the dry end of the paper machine before the reel-up. The regulation of the consistency is based on the idea that the ratio of feed of high-consistency stock to dilution water is regulated by means of valves. In the arrangement in accordance with the invention, the point of mixing of high-consistency stock is transferred from the wire pit directly to the headbox, the mixing is carried out fraction by fraction, and the dilution is carried out with white water in connection with each fraction. The process arrangement in accordance with the invention for the short circulation can be applied both to paper and board machines and to other, corresponding devices.

By means of the solution in accordance with the present invention, as compared with the prior art, clearly smaller process volumes are achieved, and it is possible to combine the operation of dilution profiling and the operation of dilution of high-consistency stock into one operation by integrating them with each other. In this way, shorter and smaller circulations are achieved, the quantities of material to be pumped are reduced, and the process volumes are smaller, which circumstances result in lower costs of operation, servicing and maintenance and, thereby, in economies. The amount of fresh water that is needed is reduced, and the recirculation of raw-materials becomes more efficient, which again reduces the loading of the environment substantially. In this way it is also possible to lower the cost of construction and operation of the wet end of a paper or board machine clearly. In the solution in accordance with the present invention, the cleaning of the stocks is carried out at a higher consistency as compared with the prior-art solutions, in which the cleaning of the stocks is carried out at the headbox consistency, which is in a range of 0.4 to 1.2%. In the solution in accordance with the present invention, the consistency of the high-consistency stock is at least 1.5% but no more than 4%. In the dilution taking place in the headbox, the consistency is lowered to the range 0.4 . . . 1.2%, depending on the paper/board grade. Further, changes of grade are very rapid, because the basis weight of the paper can be regulated very quickly, i.e. the flow of the high-consistency stock is regulated. Further, in this way, it is possible to avoid the double dilution used in the prior art.

In the system, within the scope of the inventive idea, it is possible to employ any particular headbox whatsoever that is well known in the art and that carries into effect the idea in accordance with the present invention, wires, machine screens, pumps, deaeration devices, screens, vortex cleaners, regulation apparatuses, pipe systems that interconnect the devices, and equivalent.

We claim:

1. A method of supplying stock to a headbox for injection onto a wire, comprising the steps of:

regulating by means of valves a flow of high consistency stock having a consistency of at least 1.5 percent and no more than 4.0 percent into a headbox;

simultaneously and separately regulating by valves a flow of dilution water supplied by a dilution pump, into the headbox, so that dilution of the high consistency stock takes place within the headbox to form a diluted stock having a consistency between 0.4 and 1.2 percent;

discharging the diluted stock on to the wire; and recovering water which drains from the wire as dilution water which is supplied to the dilution pump, wherein the high-consistency stock flows through a main line to a pump upstream of the headbox, and wherein a component flow is separated from the recovered dilation water, which component flow is added to the main line before the pump.

2. The method of claim 1 wherein the headbox is divided in the cross direction of the machine into a plurality of compartments, and wherein the high consistency stock and the dilution water are fed separately into each of the compartments, and wherein said high consistency stock and said dilution water are regulated so as to combine the operation of dilution profiling and the operation of dilution of the high consistency stock into one operation.

3. The method of claim 1 wherein the dilution water recovered from the wire is fed through deaeration equipment prior to flowing into the headbox.

4. A method of supplying stock to a headbox for injection onto a wire, comprising the steps of:

regulating by means of valves a flow of high consistency stock having a consistency of at least 1.5 percent and no more than 4.0 percent into a headbox;

simultaneously and separately regulating by valves a flow of dilution water supplied by a dilution pump, into the headbox, so that dilution of the high consistency stock takes place within the headbox to form a diluted stock having a consistency between 0.4 and 1.2 percent;

discharging the diluted stock on to the wire;

recovering water which drains from the wire as dilution water which is supplied to the dilution pump; and feeding the stock having a consistency of at least 1.5 percent and no more than 4 percent through a main line to a first pump before feeding into the headbox, and wherein a component flow is separated from the dilution water, which component flow is passed back to the main line before the first pump.

5. The method of claim 4 further comprising the step of feeding the dilution water through a deaeration equipment prior to being fed into the headbox.

* * * * *